US006624374B2

(12) United States Patent
Koyama et al.

(10) Patent No.: US 6,624,374 B2
(45) Date of Patent: Sep. 23, 2003

(54) SWITCHING APPARATUS

(75) Inventors: Kenichi Koyama, Tokyo (JP); Toyomi Ooshige, Tokyo (JP); Hiroyuki Sasao, Tokyo (JP); Hiroyuki Akita, Tokyo (JP); Yukimori Kishida, Tokyo (JP); Mitsuru Tsukima, Tokyo (JP); Toshie Takeuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 132 days.

(21) Appl. No.: 09/852,025

(22) Filed: May 10, 2001

(65) Prior Publication Data

US 2002/0043517 A1 Apr. 18, 2002

(30) Foreign Application Priority Data

Oct. 16, 2000 (JP) ..... 2000-315186

(51) Int. Cl.[7] ..... H01H 3/00
(52) U.S. Cl. ..... 218/154
(58) Field of Search ..... 218/140, 141, 218/154; 361/139, 160

(56) References Cited

U.S. PATENT DOCUMENTS 4,086,645 A 4/1978 Gorman et al. ..... 361/155
6,046,423 A 4/2000 Kishida et al. ..... 218/154
6,295,191 B1 * 9/2001 Kishida et al. ..... 361/139
6,353,376 B1 * 3/2002 Takeuchi et al. ..... 335/147

FOREIGN PATENT DOCUMENTS

DE 39 10010 10/1989
JP 1-253135 10/1989

OTHER PUBLICATIONS

U.S. patent application Ser. No. 09/360,690, Kishida et al., filed Jul. 26, 1999.

U.S. patent application Ser. No. 09/472,825, Takeuchi et al., filed Dec. 28, 1999.

Dalziel, I. et al.; "Application of Controlled Switching in High Voltage Systems", *CIGRÉ 1996 : 13–305*, (1996).

* cited by examiner

*Primary Examiner*—Matthew V. Nguyen
(74) *Attorney, Agent, or Firm*—Leydig, Voit & Mayer, Ltd.

(57) ABSTRACT

A switching apparatus for multiphase electric power includes switching units corresponding to different phases. Each switching unit includes an operating mechanism having a movable coil disposed between two fixed coils, and a switch portion having a movable contact operatively connected to the movable coil. A separate power supply may be provided for each switching unit to permit individual control of the different phases.

3 Claims, 5 Drawing Sheets

SWITCHING APPARATUS

REFERENCE TO RELATED APPLICATIONS

This application is based on Japanese Patent Application No. 2000-315186, filed in Japan on Oct. 16, 2000, the contents of which are hereby incorporated by reference.

BACKGROUND OF THE INVENTION

1. Field of the Invention

This invention relates to a switching apparatus which employs the interaction of magnetic fields produced by opposing coils having currents flowing through them to generate a drive force which can contact or separate contacts to close or open an electric circuit.

2. Description of the Related Art

FIG. 5 is a schematic elevation of a switching apparatus known to the inventors for multiphase electric power (such as three-phase electric power) which utilizes electromagnetic repulsive forces to carry out switching to open and close an electric circuit. FIG. 5 shows the switching apparatus in a closed contact state. The switching apparatus of FIG. 5 includes a separate switching unit 20 for each phase of electric power with respect to which switching is to take place, and the plurality of switching units 20 (three units in this case) form one group. The switching units 20 are connected to a common power supply 30 by contact opening drive current supply lines 33, which conduct based on a contact opening command 31 from a contact opening command switch, and contact closing drive current supply lines 34, which conduct based on a contact closing command 32 from a contact closing command switch.

The three switching units 20 are supported by and secured to first through fourth support plates 15–18. The switching units 20 are separated from each other by electrically insulating posts 19 which prevent the occurrence of short circuits between phases.

Each switching unit 20 has a switch portion 3 having a fixed contact 1 and a movable contact 2 which is disposed opposite the fixed contact 1 and can move into and out of contact with the fixed contact 1. A movable shaft 4 extends from the movable contact 3, and an operating mechanism 5 is operatively connected to the movable shaft 4 to open and close the switch portion 3 by translating the movable shaft 4 in its axial direction.

The fixed contact 1 of each switch portion 3 is secured to the first support plate 15 through an electrical insulator. The fixed contact 1 and the movable contact 2 are housed in an evacuated bulb 6 in order to effectively extinguish an arc which is generated during contact opening or closing.

Each movable shaft 4 includes a live portion 8 connected to the movable contact 2 and a non-live portion 9 connected to the operating mechanism 5. The live portion 8 and the non-live portion 9 are connected to each other by an electrically insulating rod 7 which prevents current from flowing from the switch portion 3 to the operating mechanism 5. A movable electrically conducting connecting terminal 10 is installed on the live portion 8 to permit connection to an external conducting body (not shown).

The operating mechanism 5 includes an electromagnetic repulsion plate 11 secured to the non-live portion 9 of the movable shaft 4, a contact opening fixed coil 12 which is secured to the second support plate 16 and opposes the upper surface of the electromagnetic repulsion plate 11, a contact closing fixed coil 13 which is secured to the third support plate 17 and opposes the lower surface of the electromagnetic repulsion plate 11, and a nonlinear bidirectional biasing spring 14 which is secured to the fourth support plate 18 and the non-live portion 9 of the movable shaft 4 and which maintains an open contact state or a closed contact state of the switch portion 3. The non-live portion 9 of the movable shaft 4 loosely passes through the second support plate 16 and the third support plate 17, through the contact opening fixed coil 12 and the contact opening fixed coil 13 which are secured to these support plates, and through the fourth support plate 18 to which the biasing spring 14 is secured so as to be able to translate in its axial direction. As a result, the electromagnetic repulsion plate 11 can reciprocate between the contact opening fixed coil 12 and the contact closing fixed coil 13. The properties of the biasing spring 14 are such that when the point of connection between the movable shaft 4 and the biasing spring 14 moves past a neutral point of the biasing spring 14, the direction in which the biasing spring 14 exerts a biasing force is reversed.

Contact opening operation of the switching apparatus of FIG. 5 is performed in the following manner. When the apparatus is in the closed contact state shown in FIG. 5 in which the fixed contacts 1 and the movable contacts 2 of the switching portions 3 contact each other, if a contact opening command 31 is provided to the power supply 30 from the contact opening command switch, the power supply 30 causes a pulse current to be supplied to the contact opening fixed coil 12 of the operating mechanism 5 of each switching unit 20 through the contact opening drive current supply lines 33. This current causes each contact opening fixed coil 12 to generate a magnetic field, and the magnetic field causes an induced current to flow in the corresponding electromagnetic repulsion plate 11, which is in a position close to and opposite the contact opening fixed coil 12, so as to generate a magnetic field which is opposite in direction to the magnetic field generated by the contact opening fixed coil 12. Due to the interaction of the magnetic field which is generated by the induced current flowing in the electromagnetic repulsion plate 11 and the magnetic field generated by the contact opening fixed coil 12, each electromagnetic repulsion plate 11 receives an electromagnetic repulsive force urging it away from the corresponding contact opening fixed coil 12.

Due to this electromagnetic repulsive force, each electromagnetic repulsion plate 11 is moved downwards in the figure against the upwards spring force exerted by the biasing spring 14 in the contact closing direction. At the same time, the movable shaft 4 which is secured to the electromagnetic repulsion plate 11 and the movable contact 2 which is secured to the movable shaft 4 also move downward, and the fixed contact 1 and the movable contact 2 are made to separate from each other, whereby each switch portion 3 is opened. During this operating process, the biasing spring 14 which was exerting a biasing force in the contact closing direction inverts its direction of action and generates a biasing force in the contact opening direction when the movable shaft 4 moves downwards past the neutral point of the biasing spring 14. Accordingly, the open contact state of the fixed contact and the movable contact 2 is maintained by the biasing spring 14.

When the switching apparatus is in the open contact state, if a contact closing command 32 is input from the contact closing command switch to the power supply 30, the power supply 30 supplies a pulse current to the contact closing fixed coil 13 of each switching unit 20 through the contact closing drive current supply lines 34. Due to this current, the contact closing fixed coil 13 generates a magnetic field, which generates an induced current in the electromagnetic repulsion plate 11 which is close to and opposing it. As a result, the electromagnetic repulsion plate 11 generates a magnetic field which is in the opposite direction of that generated by the contact closing fixed coil 13. Due to the interaction of the magnetic field generated by the contact closing fixed coil 13 and the induced magnetic field generated by the electromagnetic repulsion plate 11, a repulsive force acts on the electromagnetic repulsion plate 11 urging it away from the contact closing fixed coil 13, and the electromagnetic repulsion plate 11 moves upward against the force of the biasing spring 14 acting in the contact opening direction. As a result of this upward movement by the electromagnetic repulsion plate 11 and the movable shaft 4 connected to it, the biasing spring 14 changes from exerting a biasing force in the contact opening direction to exerting one in the contact closing direction, and when the closed contact state of FIG. 5 is reached, the biasing spring 14 maintains this state.

In the switching apparatus of FIG. 5, the magnetic field which is generated by the electromagnetic repulsion plates 11 due to induction is small compared to the magnetic field which is generated by directly supplying current to a coil, so the electromagnetic repulsive force due to the interaction of the magnetic field generated by the fixed coils 12 and 13 and the magnetic field generated in the electromagnetic repulsion plates 11 due to induction is not efficiently generated. If it is attempted to increase the generated magnetic field by increasing the number of coil windings or by increasing the size of the power supply in order to increase the pulse current applied to the fixed coils, there is the problem that the apparatus as a whole becomes large. Furthermore, the apparatus of FIG. 5 performs the contact opening and closing operation with respect to a plurality of phases simultaneously, so there are cases in which an excessive current and voltage can be generated with respect to one of the phases, and equipment connected to the switching apparatus (such as a transformer or a motor) can be adversely affected.

SUMMARY OF THE INVENTION

An object of the present invention is to obtain a switching apparatus which can decrease the energy needed for switching, which can reliably perform switching at high speed, and which can prevent the occurrence of excessive currents or voltages during contact opening or closing operation.

According to one form of the present invention, a switching apparatus includes a plurality of switching units. Each switching unit includes a switch portion having a fixed contact and a movable contact which is movable with respect to the fixed contact between an open and a closed position to open and close the switch portion, a movable shaft which extends from the movable contact, and an operating mechanism having a fixed coil and a movable coil opposing the fixed coil and operatively connected to the movable shaft for translating the movable shaft in its axial direction. The switching apparatus further includes a power supply which supplies power to at least one of the switching units.

In preferred embodiments, each operating mechanism has two fixed coils disposed on opposite sides of the movable coil.

The plurality of operating mechanisms may be driven by a single power supply, or they may be individually driven by separate power supplies.

When the switching apparatus includes a plurality of power supplies, the power supplies may be independently driven by individual command signals.

The switching apparatus may also include current and voltage measuring devices for installation on each electric power line to which the plurality of switching units are to be connected for measuring current and voltage, and a phase sensor which senses the phase in each power line based on the current and voltage measured by the corresponding current and voltage measuring device. A switching controller can than determine the optimal timing for contact opening or contact closing of the switching units based on the current and voltage measured by the measuring devices and the phase determined by the phase sensor. The switching controller then outputs an optimal timing signal to each power supply, and the operating mechanisms are driven with the optimal timing.

The switching controller may be responsive to a contact opening or closing command to output a signal indicating the optimal timing for switching to each power supply based on the command, and the operating mechanisms can be driven with the optimal timing.

The switching apparatus may include a defect sensor which senses the occurrence of a defect based on the current and voltage measured by the current and voltage measuring devices and the phase sensed by the phase sensor. When a defect is sensed, the switching controller outputs a signal with the optimal timing to each power supply.

DESCRIPTION OF PREFERRED EMBODIMENTS

Figure 1:
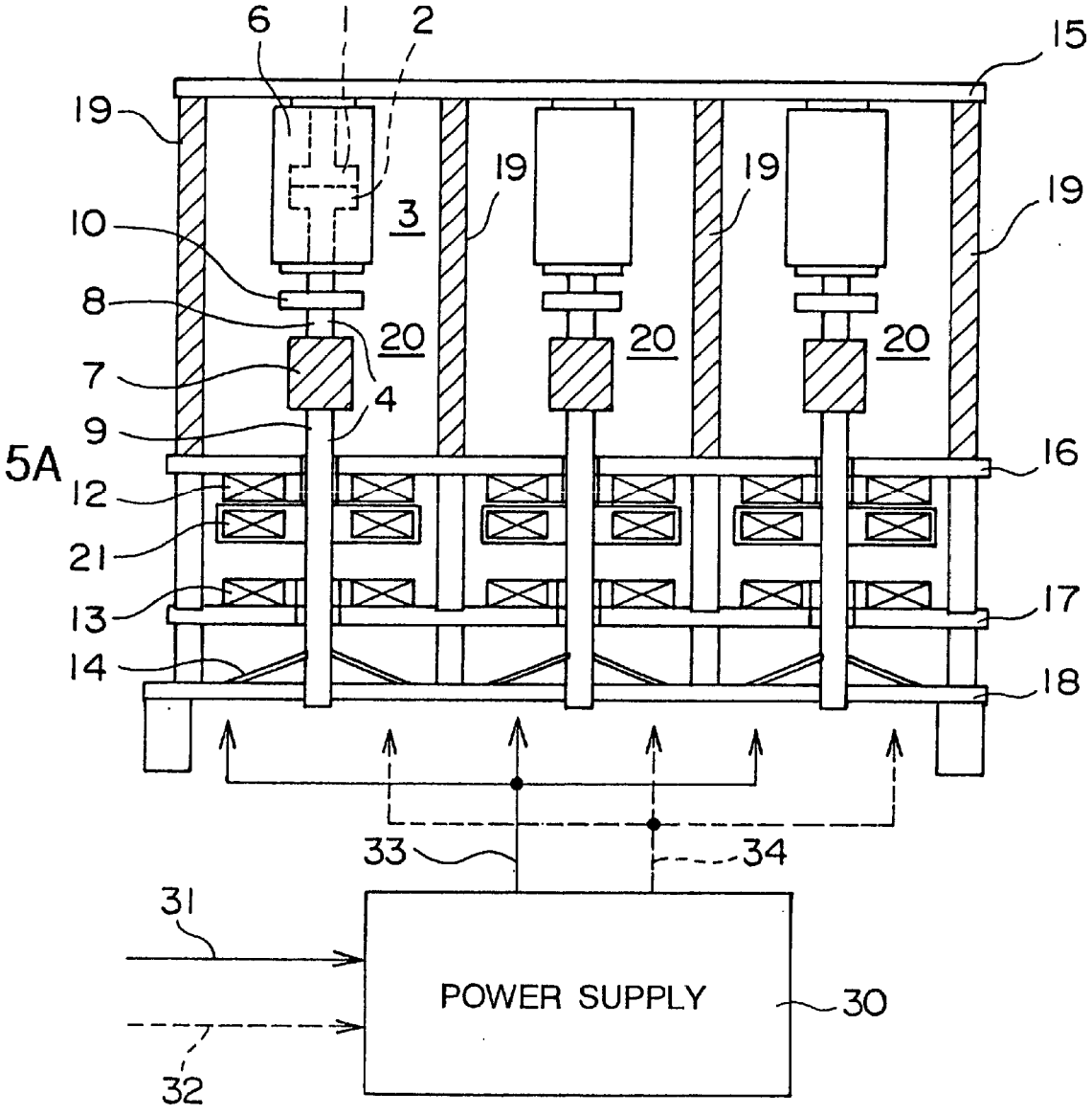
FIG. 1 is a schematic elevation of a first embodiment of a switching apparatus according to the present invention.
Figure 5:
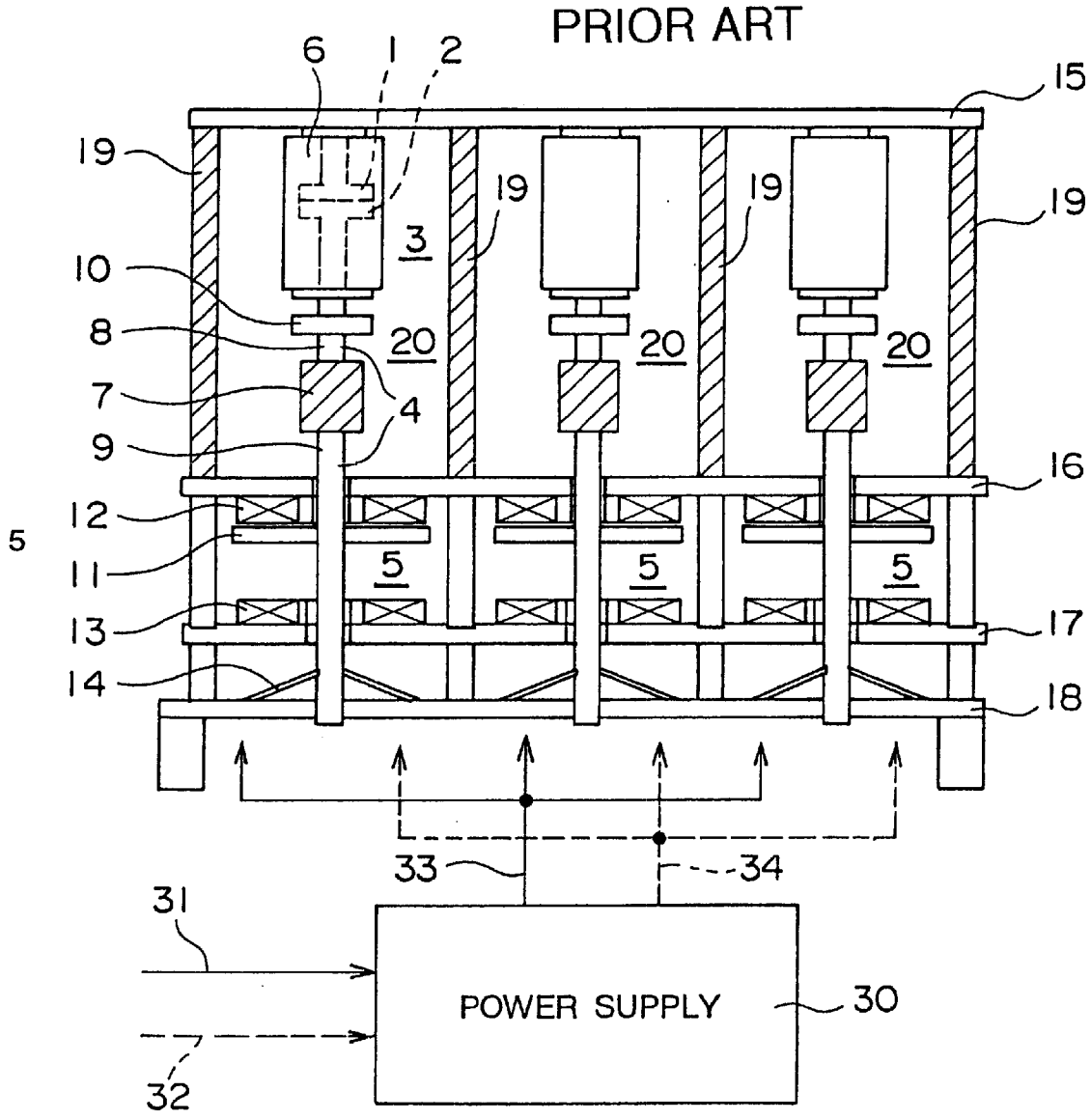
FIG. 5 PRIOR ART
FIG. 5 is a schematic elevation of a switching apparatus known to the inventors.

FIG. 1 is a schematic elevation of a first embodiment of a switching apparatus according to the present invention. In FIG. 1, the switching apparatus has a plurality of switching units each having a switch portion 3 including a fixed contact 1 and a movable contact 2 which can contact and separate from each other, a movable shaft 4 which extends from the movable contact 2, and an operating mechanism 5A which moves the movable shaft 4 to open or close the switch portion 3. Each operating mechanism 5A is similar in structure to the operating mechanisms 5 described with respect to the switching apparatus of FIG. 5 except that each of the electromagnetic repulsion plates 11 of FIG. 5 has been replaced by a movable coil 21 which is secured to the non-live portion 9 of the corresponding movable shaft 4 and which can reciprocate between the fixed coils 12 and 13 of the operating mechanism 5A in which it is installed.

Each movable coil 21 is connected to one of the contact opening drive current supply lines 33 and one of the contact closing drive current supply lines 34 from the power supply 30 such that during contact opening, the movable coil 21 generates a magnetic field which is opposite in direction to the magnetic field generated by the opposing contact opening fixed coil 12 to produce a repulsive force with respect to coil 12, and such that during contact closing, the movable coil 21 generates a magnetic field which is opposite in direction to the magnetic field generated by the opposing contact closing fixed coil 13 to produce a repulsive force with respect to coil 13.

Next, contact opening operation of this first embodiment of a switching apparatus according to the present invention will be explained. When the switching apparatus is in the closed contact state shown in FIG. 1, if a contact closing command 31 is input by the contact closing command switch to the power supply 30, the power supply 30 provides a pulse current through the current opening drive current supply lines 33 to each of the contact opening fixed coils 12 and movable coils 21, and magnetic fields are generated by these coils 12 and 21. Due to the interaction of the magnetic fields generated by opposing coils, each movable coil 21 receives an electromagnetic repulsive force which urges it away from the corresponding contact opening fixed coil 12.

Due to this electromagnetic repulsive force, each movable coil 21 moves downwards against the spring action of the corresponding biasing spring 14, and the movable shaft 4 secured to the movable coil 21 and the movable contact 2 secured to the movable shaft 4 also simultaneously move down. Due to this movement, the fixed contact 1 and the movable contact 2 of each switch portion 3 separate from each other, and each switch portion 3 is opened. The downward movement of the movable shaft 4 also inverts the direction in which the biasing spring 14 exerts a biasing force and changes it from a biasing force in the contact closing direction to a biasing force in the contact opening direction, and an open contact state is maintained by the biasing spring 14.

Accordingly, during contact opening operation of each switching unit 20, both the contact opening fixed coil 12 and the movable coil 21 generate a magnetic field. A repulsive force due to the interaction of the magnetic fields generated by the contact opening fixed coil 12 and the movable coil 21 is larger than that generated in the device of FIG. 5, so contact opening operation can be performed instantaneously and with certainty.

Next, contact closing operation will be explained. When the switching units 20 are in the open contact state, if a contact closing command 32 is input to the power supply 30 by the contact closing command switch, the power supply 30 supplies a pulse current to the contact closing fixed coil 13 and the movable coil 12 of each operating mechanism SA through the contact closing drive current supply lines 34. Due to this current, the contact closing fixed coil 13 and the movable coil 21 of each operating mechanism SA generate magnetic fields, and due to the interaction of these magnetic fields, each movable coil 21 receives an electromagnetic repulsive force which urges it away from the corresponding contact closing fixed coil 13.

Due to this electromagnetic repulsive force, the movable coil 21 moves downward against the spring action of the biasing spring 14, and the movable shaft 4 and the movable contact 2 of each switch portion 3 also move down with this movement. Along with this movement, the direction in which the biasing spring 14 exerts a biasing force changes to the contact closing direction, so when a closed contact state is reached, the biasing spring 14 maintains this state.

Accordingly, during contact closing operation, both the contact closing fixed coil 13 and the movable coil 21 of each operating mechanism 5A generate a magnetic field. Due to the interaction of these magnetic fields, an electromagnetic repulsive force can be generated which is larger than that generated by the apparatus of FIG. 5, so contact closing operation can be performed instantaneously and with certainty.

In this embodiment, contact opening operation and contact closing operation are carried out by the repulsion due to the interaction of the magnetic fields of the contact opening fixed coil and the movable coil and using the repulsion due to the interaction of the magnetic fields of the contact closing fixed coil and the movable coil, respectively, but the same effects can be achieved by driving using the repulsion force on only one side.

Figure 2:
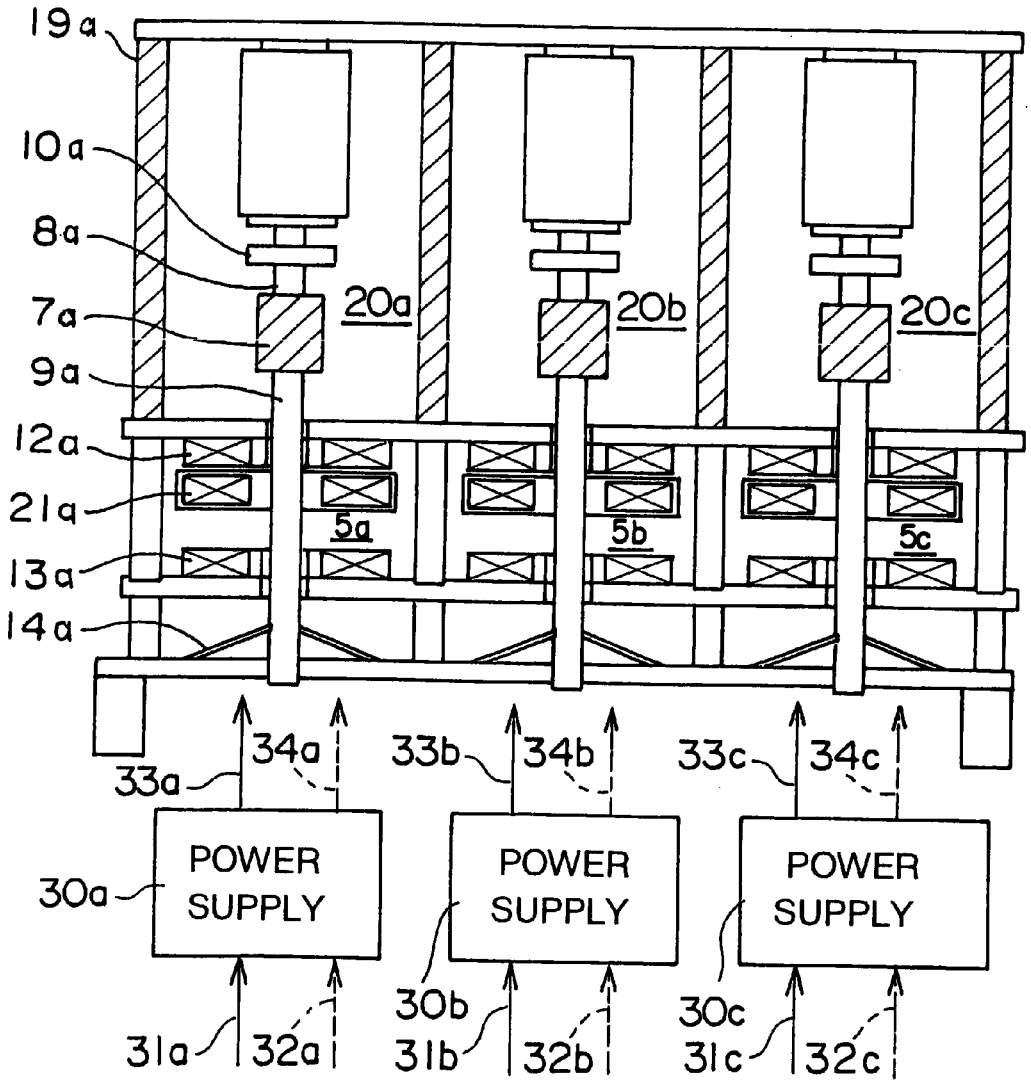
FIG. 2 is a schematic elevation of a second embodiment of a switching apparatus according to the present invention.

FIG. 2 is a schematic elevation of a second embodiment of a switching apparatus according to the present invention. In FIG. 2, separate power supplies 30*a*, 30*b*, and 30*c* are each connected to one of three switching units 20*a*, 20*b*, and 20*c* of a switching apparatus used for three-phase electric power through contact opening drive current supply lines 33*a*, 33*b*, and 33*c* and contact closing drive current supply lines 34*a*, 34*b*, and 34*c*, respectively. Each of the power supplies 30*a*, 30*b*, and 30*c* is connected to a corresponding contact opening command switch which generates a corresponding contact opening command 31*a*, 31*b*, and 31*c*, respectively, and is also connected to contact closing command switches which Generate contact closing commands 32*a*, 32*b*, and 32*c*, respectively. A command mechanism for outputting drive commands to the plurality of power supplies 30*a*, 30*b*, and 30*c* comprises the contact opening command switches and the contact closing command switches, and the operating mechanisms 5*a*, 5*b*, and 5*c* are independently driven by the commands from the command mechanism. The structure of this embodiment is otherwise the same as that of the embodiment shown in FIG. 1. The switching units 20*a*, 20*b*, and 20*c* include the same components as each other. In order to distinguish the components of different switching units, the reference numbers for components of switching units 20*a*, 20*b*, or 20*c* will be affixed with letter a, b, or c, respectively.

Next, contact opening operation of this second embodiment of the present invention will be explained. When all of the switching units 20*a*, 20*b*, and 20*c* are in a closed contact state, if a contact opening command 31*a* is generated only by the contact opening command switch for power supply 30*a*, power supply 30*a* supplies a pulse current through contact opening drive current supply line 33*a* to the contact opening fixed coil 12*a* and the movable coil 21*a* of switching unit 20*a*, and coils 12*a* and 21*a* generate an electromagnetic repulsive force. Due to the repulsive force, switching unit 20*a* performs contact opening. The other two switching units 20*b* and 20*c* have not received a contact opening command, so they remain in a closed contact state.

Switching units 20*b* and 20*c* can also individually perform contact opening operation if a contact opening command 31*b* or 31*c*, respectively, is output from the corresponding contact opening command switches.

Next, contact closing operation will be described. When each of switching units 20*a*, 20*b*, and 20*c* is in an open contact state, if a contact closing command 32*a* is input only to switching unit 20*a* from the corresponding contact closing command switch, the contact closing fixed coil 13*a* and the movable coil 12*a* of switching unit 20*a* are made to conduct and generate an electromagnetic force which repels them from each other. Due to this repulsive force, the movable coil 21 of switching unit 20*a* is pushed upwards, and switching unit 20*a* assumes a closed contact state, while the other switching units 20*b* and 20*c* maintain their previous state. At this time, the direction in which the biasing spring 14*a* exerts a biasing force changes to the contact closing direction, so a closed contact state of switching unit 20*a* is maintained by biasing spring 14*a*.

In the same manner, switching units 20*b* and 20*c* can also be individually closed by a contact closing command 32*b* or 32*c*, respectively, from the corresponding contact closing command switches.

Accordingly, in this embodiment, operation can be performed such that the phase angle which minimizes the excess current or voltage which is generated at the time of contact opening or contact closing is separately determined for each phase. Although this embodiment employs a movable coil 21*a*–21*c* in each switching unit 20*a*–20*c*, the advantages of individual control of different phases can also be obtained if each movable coil is replaced by an electromagnetic repulsion plate, like plate 11 of FIG. 5.

Figure 3:
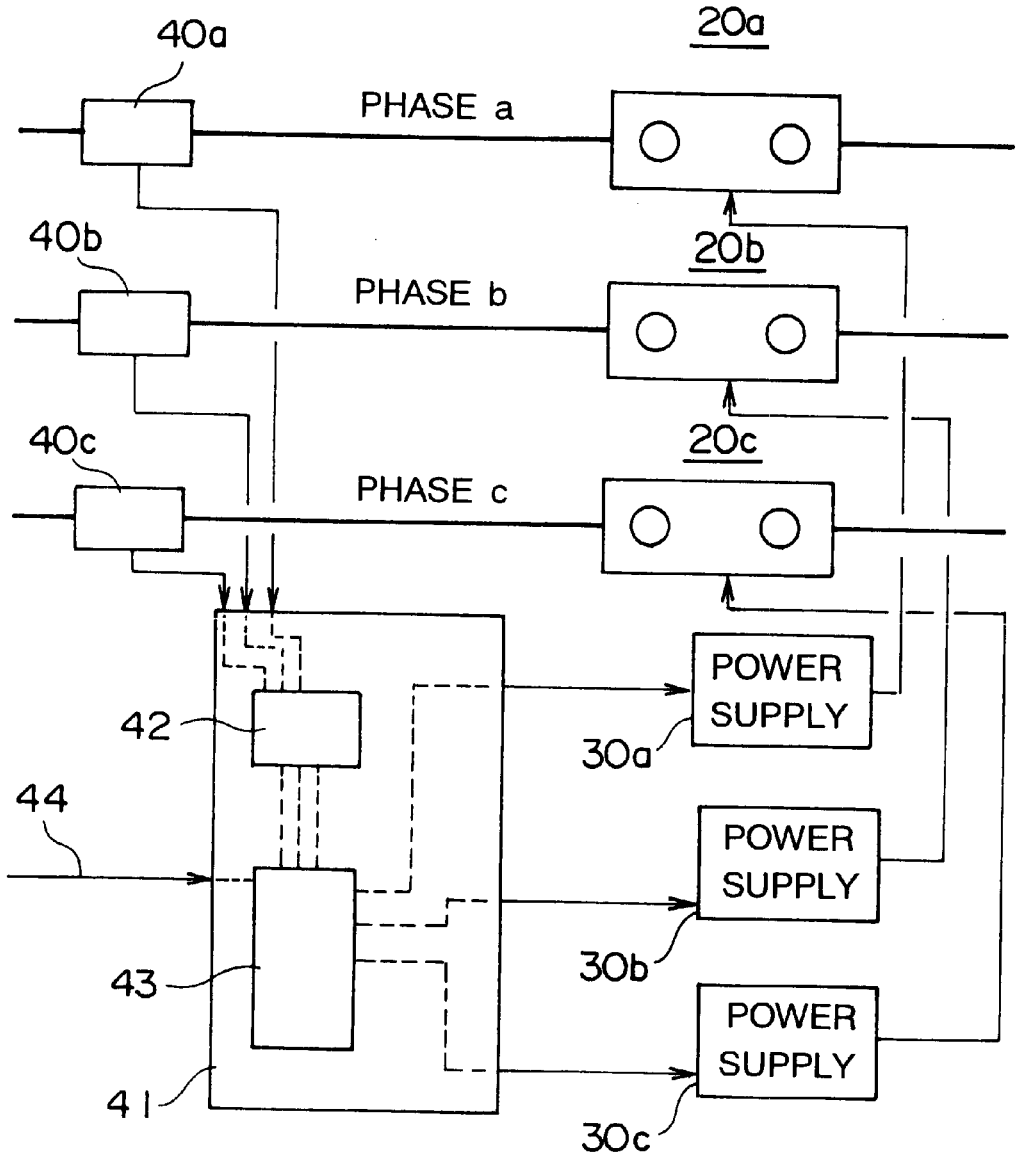
FIG. 3 is a block diagram of a third embodiment of a switching apparatus according to the present invention.

FIG. 3 is a block diagram of a third embodiment of a switching apparatus according to the present invention, which includes a control system. The switching apparatus includes three switching units 20*a*, 20*b*, and 20*c* which may have the same structure as those of the embodiment of FIG. 2, so they are shown only schematically in FIG. 3. Each switching unit is connected to an electric power line for a different phase of 3-phase power to perform connection or disconnection of the corresponding power line. The three phases will be referred to as phase a, phase b, and phase c, respectively. Current and voltage measuring devices 40*a*, 40*b*, and 40*c* are installed on the power lines for phase a, phase b, and phase c, respectively, to constantly measure the current and voltage in each power line. The current and voltage measuring devices 40*a*, 40*b*, and 40*c* are connected to a switching controller 41 through corresponding signal lines. The switching controller 41 includes a phase sensing portion 42 which senses the phase of each power line based on the current and voltage measured by the current and voltage measuring devices 40*a*–40*c*, and a switching control portion 43 which determines the timing of contact opening or closing based on the current, the voltage, and the phase. The switching control portion 43 also determines the timing of contact opening and contact closing based on a contact opening or closing command 44 from a switching command switch and outputs it. Power supplies 30*a*, 30*b*, and 30*c* are connected to switching units 20*a*, 20*b*, and 20*c*, respectively, and a corresponding output line from the switching controller 41 is connected to each power supply 20*a*–20*c*.

At the time of contact opening or contact closing of the switching apparatus, if a contact opening or contact closing command 44 is generated by the switching command switch, the command 44 is input to the switching control portion 43 inside the switching controller 41. The switching control portion 43 receives signals indicating the current and voltage for each phase which are constantly measured by the current and voltage measuring devices 40*a*, 40*b*, and 40*c* and the phase of the power in each power line which is detected by the phase sensing portion 42. Based on the current, the voltage, and the phase, the switching control portion 43 determines the timing so that excess current and voltage in each phase at the time of contact closing or contact opening is minimized, and it individually outputs a contact opening or contact closing command for each phase with this timing to power supplies 30*a*, 30*b*, and 30*c*. Based on the input from the switching control portion 43, the power supplies 30*a*, 30*b*, and 30*c* individually transmit drive current to the corresponding switching units 20*a*–20*c*, and the switching units 20*a*–20*c* perform switching operation in the same manner as in the embodiment of FIG. 2. Thus, contact opening or contact closing is individually carried out for each switching unit 20*a*, 20*b*, and 20*c*, and interruption or connection of phase a, phase b, and phase c is carried out.

Accordingly, with the structure illustrated in FIG. 3, contact opening operation or contact closing operation can be performed for each switching unit 20*a*–20*c* with a timing such that the excess current and voltage which is generated at the time of contact closing or contact opening is minimized, and the effect of contact opening or closing on equipment connected to the switching apparatus (such as transformers or motors) is decreased.

Figure 4:
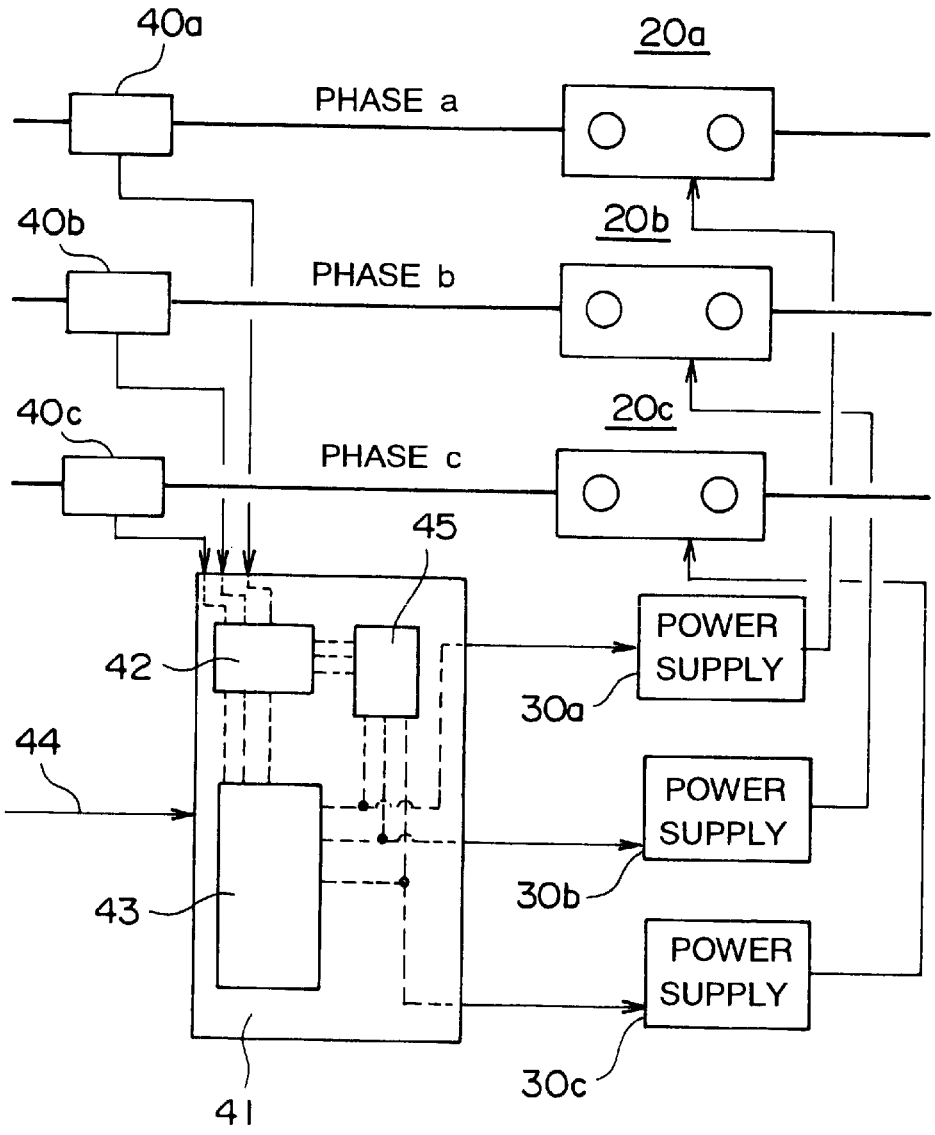
FIG. 4 is a block diagram of a fourth embodiment of a switching apparatus according to the present invention.

FIG. 4 is a block diagram of a fourth embodiment of a switching apparatus according to the present invention, which includes a control system. This embodiment is similar in structure to the embodiment of FIG. 3, but the switching controller 41 further includes a defect sensing portion 45 connected to the phase sensing portion 42 by a signal line for each phase. The defect sensing portion 45 is also connected to the power supply 30*a*, 30*b*, and 30*c* for each phase through corresponding output lines. The structure of this embodiment is otherwise the same as for the embodiment of FIG. 3.

Next, the operation of the embodiment of FIG. 4 will be explained. When a defect such as a short circuit or insufficient voltage occurs in the power line for any one of the three phases, the output signal from the current and voltage measuring devices 40*a*, 40*b*, or 40*c* for the power line in which the defect occurred will have a value indicating the occurrence of a large current due to a short circuit or an insufficient voltage. The output signals from the current and voltage measuring devices 40*a*–40*c* are input to the phase sensing portion 42 of the switching controller 41, and the phase sensing portion 42 senses the phase in each power line and supplies an input signal indicating the current, the voltage, and the phase to the defect sensing portion 45. Based on the current, voltage, and phase resulting from the defect, the defect sensing portion 45 outputs a contact opening command to each power supply with a timing such that the most excessive current and voltage for each phase is decreased and such that contact opening will take place with certainty. Based on the contact opening command from the defect sensing portion 45, each power supply 30*a*–30*c* opens the corresponding switching unit 20*a*–20*c*.

When it is necessary for the defect sensing portion 45 to instantaneously remove a defect, it may be constructed so as to instantaneously output a contact opening command for each phase at the same time.

In each of the above-described embodiments of the present invention, the case of three-phase electric power was described, but the present invention is not limited to three phases and it can be applied in the same manner to a different number of phases.

As is clear from the above description, the present invention can provide benefits such as the following:

(1) According to one form of the present invention, a switching apparatus includes a plurality of switching units, each switching unit comprising a switch portion having a fixed contact and a movable contact which is movable with respect to the fixed contact between an open and a closed position to open and close the switch portion, a movable shaft which extends from the movable contact, and an operating mechanism having a fixed coil and a movable coil opposing the fixed coil and operatively connected to the movable shaft for translating the movable shaft in its axial direction. As a result, a switching apparatus is obtained which has operating mechanisms with a large switching force, which can perform switching operation instantaneously, and which can perform disconnecting and connecting with certainty and with high precision.

(2) In preferred embodiments, each operating mechanism has a movable coil disposed between two fixed coils. As a result, a switching apparatus is obtained with operating mechanisms which can generate a large switching force and which can perform switching operation instantaneously, and which can perform disconnecting and connecting with certainty and with high precision.

(3) When the plurality of operating mechanisms are individually driven by separate power supplies, a switching apparatus is obtained which enables contact opening or contact closing operation to be performed separately with respect to each phase and which can decrease an excess current or voltage which is generated at the time of contact opening or contact closing.

(4) When the plurality of power supplies are independently driven by individual command signals, a switching apparatus is obtained which can separately perform contact opening or contact closing operation with respect to each phase during maintenance inspection and which can decrease an excess current and voltage which is generated at the time of contact opening and contact closing and which can increase reliability.

(5) When the switching apparatus includes current and voltage measuring devices for measuring the current and voltage of each phase, a phase sensor which senses phase, and a switching controller which determines the optimal timing for contact opening or contact closing, a switching apparatus of high reliability is obtained which can suppress an excess current and voltage which is generated during contact opening or contact closing to a minimal value.

(6) In one form the present invention, the switching controller may be responsive to a contact opening or closing command to output a signal indicating the optimal timing for switching to each power supply based on the command, and the operating mechanisms can be driven with the optimal timing. Therefore, a switching apparatus of increased reliability is obtained which can suppress an excess current and voltage which is generated at the time of contact opening or closing to a minimum.

(7) When the switching apparatus includes a defect sensor which senses the occurrence of a defect based on the current and voltage measured by the current and voltage measuring devices and the phase sensed by the phase sensor, a switching apparatus of high reliability is obtained which can stop an abnormal current and an abnormal voltage at the time of a defect instantaneously and with certainty.

What is claimed is:

1. A switching apparatus comprising:

a plurality of switching units, each switching unit comprising a switch portion having a fixed contact and a movable contact movable with respect to the fixed contact between an open position and a closed position, opening and closing the switch portion, a movable shaft which extends from the movable contact, and an operating mechanism operatively connected to the movable shaft to translate the movable shaft in an axial direction;

a plurality of power supplies providing electrical power to the operating mechanisms of the plurality of switching units for opening and closing the respective switch portions, each power supply being associated with and supplying electrical power to a different, respective one of the operating mechanisms for actuating the respective operating mechanism independent of actuating others of the operating mechanisms;

a plurality of current and voltage measuring devices, each of the current and voltage measuring devices being connected to a respective electrical vower line to which a corresponding one of the switching units is connected, to measure the current and voltage of the respective electrical power line;

a switching controller including a phase sensor responsive to the current and voltage measuring devices and sensing the phase of electrical power of the respective electrical power line to which the respective current and voltage measuring device is connected, based on the current and voltage measured by the current and voltage measuring devices, the switching controller determining timing for contact opening and closing of the respective switching units based on the phase sensed by the phase sensor and the currents and the voltages measured by the respective current and voltage measuring devices and outputting a signal indicating the timing for contact opening and closing to each respective power supply; and a defect sensor responsive to the respective current and voltage measuring devices and the phase sensor and which detects a defect on the electrical power lines to which the respective current and voltage devices and the phase sensor are connected, based on the currents, the voltages, and the phase measured and sensed.

2. The switching apparatus as claimed in claim 1, wherein the switching controller generates the signal indicating timing for one of contact opening and closing in response to an opening or closing command.

3. The switching apparatus as claimed in claim 1, wherein each of said switching units switches a separate phase of a multiple phase electrical power line and each of the switching units is commonly mounted to a plurality of support plates.

* * * * *